US005295328A

United States Patent [19]

Olbrich

[11] Patent Number: 5,295,328

[45] Date of Patent: Mar. 22, 1994

[54] DEVICE FOR THE SHARPENING, GRINDING AND POLISHING OF DENTAL, PARODENTAL AND/OR SURGICAL INSTRUMENTS

[75] Inventor: Kurt Olbrich, Mossautal, Fed. Rep. of Germany

[73] Assignee: Roswitha Quetin, Fed. Rep. of Germany

[21] Appl. No.: 877,169

[22] PCT Filed: Nov. 26, 1991

[86] PCT No.: PCT/EP91/02237

§ 371 Date: Jul. 1, 1992

§ 102(e) Date: Jul. 1, 1992

[87] PCT Pub. No.: WO92/09403

PCT Pub. Date: Jun. 11, 1992

[30] Foreign Application Priority Data

Nov. 26, 1990 [DE] Fed. Rep. of Germany ..... 4037591
Feb. 16, 1991 [DE] Fed. Rep. of Germany ..... 4104824
May 25, 1991 [DE] Fed. Rep. of Germany ..... 4117147

[51] Int. Cl.[5] ..... B24B 3/36

[52] U.S. Cl. ..... 51/122; 51/231; 51/109 BS; 51/166 MH

[58] Field of Search ..... 51/122, 166 TS, 166 MH, 51/121, 128, 231, 92 BS, 109 BS, 91 BS, 114, 216 ND, 217 A, 165.79

[56] References Cited

U.S. PATENT DOCUMENTS

| | | | |
|---|---|---|---|
| 1,419,140 | 6/1922 | Hutchinson | 51/166 MH |
| 1,501,327 | 7/1924 | Fox | 51/166 MH |
| 2,511,449 | 6/1950 | Springman | 51/114 |
| 3,879,899 | 4/1975 | Ribar | 51/231 |
| 4,259,814 | 4/1981 | Glaser | 51/122 |
| 4,854,080 | 8/1989 | Romhild et al. | 51/55 |

FOREIGN PATENT DOCUMENTS

| | | | |
|---|---|---|---|
| 0829709 | 1/1952 | Fed. Rep. of Germany | 51/166 MH |
| 2482889 | 11/1981 | France | 51/92 BS |
| 43-10598 | 5/1968 | Japan | 51/114 |

*Primary Examiner*—Robert A. Rose
*Attorney, Agent, or Firm*—Diller, Ramik & Wight

[57] ABSTRACT

The disclosure is directed to a device for the sharpening, grinding and polishing of dental, parodental or surgical instruments, comprising a grinding body (48) with a grinding surface, said grinding body (48) being carried by a support structure (36) consisting of arms forming a rectangle, with the support structure (36) being arranged for rotation and the instrument (12) to be ground being clamped in a clamping means (28). The rotatable support structure (38) is displaceable relative to the clamping means (28).

23 Claims, 8 Drawing Sheets

DEVICE FOR THE SHARPENING, GRINDING AND POLISHING OF DENTAL, PARODENTAL AND/OR SURGICAL INSTRUMENTS

BACKGROUND OF THE INVENTION

The invention is directed to a device a device for the sharpening, grinding and polishing of dental, parodental and/or surgical instruments of the type indicated in the preamble of claims 1, 2 or 10.

The maintenance of medical instruments, e.g. dental, parodental and/or surgical instruments, which are not provided for disposal after use, is an essential requirement for a successful therapy. Maintenance of these instruments comprises, among others, sharpening, renewed cutting, grinding and polishing of instruments which have become blunt or notched by usage or have become unfit for optimum use due to other influences. Particularly in the field of dentistry, it is often tried to re-grind or re sharpen precious instruments such as scalers, curettes, gingival border beaters, excavators, carving instruments, rasps, root lifters, scissors, sharp spoons etc. so that these instruments can be successfully used several times.

For avoiding bothersome manual grinding, there are used hand- or motor-driven grinding devices. However, because of the restricted variabilty of such devices, only certain instruments can be treated successfully. Among these are scalers, curettes, Hoe scalers and gingival border beaters.

EP-A-0 307 740 is directed to a device for the sharpening of the cutting edges of scalers clamped in a holding device and of other parodental instruments by means of a motor-driven grinding disk. By the device described therein, a re-grinding of the cutting edge of parodental instruments shall be reproducible, i.e. be feasible at identical grinding angles and an identical grinding pressure during each use. The grinding body to be used for sharpening, provided as a grinding disk, is rotatably supported on a bearing block resting on a support structure. The support structure comprises two support arms being articulated to the bearing block and having their free ends articulated to each other by a connecting member. The four joints between the bearing block, the support arms and the connecting member form a parallelogram. The ,support structure is arranged for rotation so that the grinding body performs a circular movement upon rotation of the support structure. The support structure projects from an opening in the upper side of a base housing having two holding arms arranged thereon, with the clamping device being supported for rotation about a horizontal axis between said arms. The connecting member connecting the two support arms of the support structure is pivotable. Through a horizontally displaceable sliding block, abutting a stationary control member and being displaced while scanning the control surface thereof during rotation of the support structure, the connecting member is pivoted about its pivoting point. At the same time, while the grinding body is in abutment on the instrument, the support arms of the support structure move relative to each other, resulting in a pivoting of the bearing block and thus a change of the inclination of the grinding surface of the grinding body. By controlling the inclination of the grinding surface in this manner, grinding can be performed on instruments as e.g. scalers or curettes wherein the inclination angle of the grinding surface at the lateral faces of the instrument and that at the acute end have to be selected differently.

The support structure of the known grinding machine can be rotated about a stationary vertical axis only. Instruments wherein the grinding body must be longitudinally displaceable along the cutting edges thereof for sharpening the instrument over its whole length, can be treated only in a restricted manner or not at all by the known device. Further, the clamping means allows clamping of only a limited number of different instruments.

SUMMARY OF THE INVENTION

It is the object of the invention to provide a device for the sharpening, grinding and polishing of dental, parodental and/or surgical instruments which is adapted for sharpening a large variety of differently formed instruments, allowing high variability of the grinding movement and adjustment of the grinding angle to the respective rotational movement and thus high accuracy of the grinding process while exactly maintaining the optimum grinding angle.

For solving the above object, the invention provides a grinding machine comprising the features respectively mentioned in the independent claims; advantageous embodiments of the invention are mentioned in the subclaims.

According to the invention, the support structure and the control member are arranged on a common holding element, the support structure being rotatably mounted on the holding element and the control member being rigidly attached thereon. The holding element in turn is displaceably supported in or on the base housing. Support of the holding element is provided in such a manner that the holding element can be displaced about at least one axis extending perpendicularly to the rotational axis of the support structure. Orientation of this axis is selected such that the holding element can be moved towards the clamping device and away from it. Thereby, it is possible that the grinding surface—without rotation of the support structure—is moved along a face of the instrument to be treated by merely displacing the support structure (and the holding element) in linear fashion. Since the support structure is not rotated in that case, the inclination of the grinding surface is maintained, which is desirable in connection with instruments of the above kind (scissors or chisel).

Also, because of the longitudinally displaceable support of the holding element, the entire support structure along with the grinding body can be advanced with still greater accuracy to an instrument to be treated all around or on several sides. A fixing means can be used for fixing the holding element in the selected position; accordingly, by rotating the support structure, the grinding process can be performed with the inclination of the grinding angle changing in dependence of the angle of rotation. After release of the fixing means, the support structure can be moved freely again.

The fact that the holding element is moveably supported allows for displacement of the support structure within the opening in the base housing. To this effect, longitudinal displacement of the support structure must be possible about two axes arranged at a right angle to each other, said axes further extending at right angles to the rotational axis of the support structure. If, however, the end of the instrument to be worked on is arranged centrally, it will be sufficient to provide the holding element for displacement along one axis.

According to the invention, the effect that the support structure can be displaced in longitudinal direction while at the same time maintaining the control of the inclination of the grinding surface upon rotation of the support structure, is obtained in that the control organ, instead of being fixed to the base housing, is attached rigidly on the holding element which in turn is displaceable relative to the base housing.

An additional essential aspect of the invention pertains to the relative arrangement of the control member and the connecting member whose movement is controlled by the control member. According to a variant of the invention, it is provided that the connecting member weighs on the control member or rests thereon under the action of a spring and, upon rotation of the support structure, can be pivoted up and down by the control member. For allowing inclination of the bearing block and thus of the grinding body along with its grinding surface, the connecting member has to be pivoted. This pivoting movement is realized in a simple constructional manner by providing that the connecting member weighs on the control member from above or, under a biasing force, abuts on the control member and thus on the control face thereof from above. This direct control of the connecting member is relatively simple in constructional terms and more reliable than an arrangement wherein a control element provided between the control member and the connecting member has to translate the movement of the control element determined by the contour of the control member, into a upward or downward pivoting movement of the connecting member.

Preferably, the connecting member is provided with a scanning element, e.g. a sliding or rolling body, with the scanning element upon rotation of the support structure moving along a control face provided on the control member, the contour of said control face being formed in such a manner that the connecting member takes on different pivoting positions upon rotation of the support structure.

In an advantageous embodiment of the invention, it is provided that the connecting member is articulated to an arm which in turn is articulated to another connecting member which, as is the case with the connecting member belonging to the support structure, is articulated to a rotatably supported holding member of the holding element; the four connecting points of the two connecting members to the holding member and the arm define the corners of a parallelogram. This arm, extending substantially vertically and in parallel to the holding member, forms the scanning element abutting the control face of the control member. The guiding of this arm as part of a parallelogram guarantees the maintenance of the substantially vertical orientation of the arm when the latter follows the control face of the control member by upward and downward movements.

In connection with the above explained parallelogram, it is advantageous if the control member is formed as a cylindrical annular body arranged coaxially to the rotational axis of the support structure and having one of its annular facial surfaces provided as a control face for controlling the movement of the connecting member during rotation of the support structure; when seen in circumferential direction, the annular body has portions of different axial lengths, i.e. is stepped, with the transition portions formed by inclined connecting faces. The pivoting movements performed by the connecting member during one revolution of the support structure amount to just a few degrees; for this reason, the arm provided with the scanning element is displaced only by a small distance in horizontal direction. Thus, the annular facial surface need only have a small width for safeguarding that the scanning element of the arm runs or slides by 360° on the annular facial surface.

By maintaining the orientation of the arm for adjusting the connecting member of the support structure, the control member can be rather simple in construction. Notably, irrespective of the pivoting position of the connecting member of the support structure, the distance of the connecting member from the control member or the control face thereof is determined by the length of the arm and the unchanged position thereof. Pivoting of the connecting member does not lead to a turning of the arm so that in this respect the conditions are always the same.

Preferably, there are provided two stoppers for delimiting the rotational angle by which the support structure can be rotated to about 180° in both rotational directions, namely in such a manner that the grinding surface comes into contact only with the lateral faces and the instrument tip which is to be sharpened, when the support structure is rotated by 180° about the acute end of the instrument. By the provision of these stoppers, it is precluded that the lateral faces of an instrument are subjected to the sharpening action also in the transition region to the tang by which the instrument end to be treated is connected to a handle. Sharp edges on this portion of the instruments can cause injuries to the patient.

Preferably, the stoppers are provided as snap-in stoppers allowing further rotation of the support structure when a specific rotational force is exceeded. Thus, if it is necessary in certain cases to rotate the support structure beyond the range of rotational angles limited by the two stoppers, this will be possible when the two stoppers are formed as snap-in stoppers, i.e. as yielding stoppers. For the snap-in stoppers, there are preferably used spring-loaded balls arranged in the upper side of the base housing in the region of the edge of its opening. The opening of the base housing and the opening edge are covered by a disk or the like being rotatably supported on the holding member and carrying the support structure. Thus, the disk is rotated upon rotation of the support structure or, respectively, the support structure can be rotated by rotating the disk. Also, longitudinal displacement of the support structure can be effected by displacing the rotary disk. On the lower side of the rotary disk facing the upper side of the base housing, there are arranged two radial ribs displaced by 180°, i.e. arranged diametrically opposite each other, for abutting on the snap-in ball upon rotation of the rotary disk. Since said ribs extend in radial direction, they contact the snap-in ball in each position of the longitudinal displacement of the rotary disk when the rotary disk is rotated.

In an advantageous embodiment of the invention, is is provided that the inclination of the grinding surface of the grinding body can be preset. To this effect, it is preferably provided that the bearing block is arranged as a two-part structure and comprises a first element rotatably holding the grinding body, and a second element having the support arms articulated thereto. The two elements can be pivoted relative to each other about an axis, with the respective pivoting position of the first element being fixable on the second element. In this manner, continuous or other adjustment of the first element relative to the second element is possible. A pointer device on one element and a scale means on the other one are provided for reading the preset value.

An advantageous embodiment of the invention provides, besides the fixing means for fixing the longitudinally displaceable holding element, a further fixing means for securing the support structure against rotation. Both of the fixing means are arranged as adjusting and fixing screws for impeding or completely preventing the rotational movement on the one hand and the longitudinal movement on the other hand through increased friction. For being able to grind or work with high accuracy, it can be advantageous that rotation or shifting of the support structure and the holding element is possible only upon application of a required minimum force. This option of friction adjustment will be used especially when the persons carrying out the grinding reveal individual differences in handling due to differences in fine motoricity.

The support structure is biased by a spring against the clamped instrument end of to be ground; thus, the grinding surface always abuts with a specific bias force on the instrument or the end thereof. By changing the point of attack of this spring, which is preferably arranged between one of the support arms and the holding member having the connecting member articulated thereto, the bias force is set. To this purpose, it is advantageously provided that one point of attack of the spring can be changed through an adjustment screw. This is a reasonable feature particularly in case of thin, pointed instruments because too high pressure forces, as required e.g. in the grinding of chisel-like instruments, would practically "grind off" the instrument.

A further preferred embodiment of the invention is obtained by a special arrangement of the motor-driven grinding body. In this embodiment, the grinding body is supported in the bearing block in axially resilient fashion. This axially resilient suspension of the grinding body offers the advantage that especially in the front portion of scalers and curettes, the pressing force of the rotating grinding body is low, particularly with very narrow, pointedly or roundly ending contours of the ends to be ground, the abrasion is correspondingly small so that a compensation is provided as compared to straight faces extending in width direction. Thus, the original contours of the ground instruments can be preserved over a long span of time inspite of repeated regrinding.

In a further variant of the device of the invention, there is provided an auxiliary adjusting means for the instrument, serving for adjusting the instrument prior to clamping by the clamping means; this adjustment is carried out in that the instrument end to be treated is clamped tight in such a manner that the facial surface of the instrument extends perpendicularly to the rotational axis of the support structure; the clamping means is rotatable and/or movable about several axes so that the clamping means, while the instrument is held by the auxiliary adjusting means, can be moved towards the instrument and/or be rotated in such a manner that the instrument can be clamped tight on its handle portion while maintaining the orientation determined by the fixing of the end to be treated.

Satisfactory results in grinding of the instruments can be obtained only if the facial surface of the instrument is oriented in plane parallel manner, i.e. at a right angle to the rotational axis of the support structure. For adjusting the instruments, preferred use is made of an auxiliary adjusting means. In a preferred embodiment of the invention, the auxiliary adjusting means comprises a clamping unit for holding the instrument at the end thereof to be treated, and can be mounted between two holding arms for fixed arrangement therebetween. When the instrument is held by the clamping unit of the auxiliary adjusting means, the facial surface thereof is in plane parallel orientation. Now, the clamping means which clampingly holds the instrument on its working handle during the actual grinding process, can be advanced to the instrument so that the instrument is clamped in that position into which it has been brought before by the auxiliary adjusting means. Once the instrument is held on its working handle by the clamping means, the auxiliary adjusting means can be removed and the grinding process can be started.

Advantageously, the auxiliary adjusting means is provided as a rod to be inserted between the holding arms, the clamping unit for holding the instrument on the end to be treated being arranged in the central portion of said rod with plane parallel orientation of the facial surface. Preferably, the clamping unit comprises a stationary first clamping jaw extending in the longitudinal direction of the rod, and a second clamping jaw to be moved radially with respect to the rod and being displaceably supported on a holding element connected to the rod; preferably, the first clamping jaw is provided with a rounded face opposite the second clamping jaw. This rounded face, together with the clamping unit of the auxiliary adjusting means, makes it possible to clamp instruments wherein the ends to be treated have ends with different curves. Thus, the auxiliary adjusting means is suited practically for all dental, parodontal and surgical instruments. For fixing the auxiliary adjusting means on the holding arms of the grinding device, it is advantageously provided that the auxiliary adjusting means at the ends thereof facing the holding arms is provided with pins for engaging into appertaining receiving bores on the holding arms; for preventing a rotational movement of the auxiliary adjusting means, two pins of this type are arranged at least one end and two corresponding receiving bores are arranged on the associated holding arm. The other end of the auxiliary adjusting means, advantageously carrying one pin only, is spring loaded and thus can be pushed back against the force of the spring for moving the pin out of its engagement with the appertaining receiving bore in order to insert the auxiliary adjusting means between the holding arms or removing it from the holding arms.

In the above described auxiliary adjusting means, the instrument is held by the clamping means in such a manner that the facial surface of the instrument is arranged in plane-parallel orientation. Subsequently, when the instrument is gripped on the holding handle by the clamping means, it is already in the "right" position for grinding. In another embodiment of the invention, it is provided that the auxiliary adjusting means is arranged as a rod, to be inserted between the two holding arms, which has a marking by which optical adjustment of the instrument end to be treated can be performed prior to clamping the instrument in the clamping means. This auxiliary adjusting means first allows only height adjustment and a centering of the end to be treated. First, the auxiliary adjusting means serves for holding the instrument by hand according to the marking to then clamp it in this position by the clamping means. For plane parallel orientation of the facial surface of the thus clamped instrument, there is required a further auxiliary adjusting means which for clamped fixation against the facial surface comprises a pin resilently pressing thereagainst. When this further auxiliary adjusting means is clamped to the instrument end to be treated, the pin occupies a position in space corresponding to the orientation of the facial surface. Now, by moving the clamping means, the instrument can be brought into a position wherein the pin extends in horizontal direction. Thus, there is obtained the plane parallel orientation of the facial surface so that said further auxiliary adjusting means can be removed and the grinding process can be started.

Basically, when using the auxiliary adjusting means for clamping the instrument, any desired clamping means can be used during the actual grinding process. Preferably, however, there is used a clamping means comprising a clamping jaw arrangement whose clamping jaws grip the instrument on both sides at the working handle, the space between the clamping jaws being opened substantially on all sides. By such a clamping means, the working handle of the instrument, whose position in space is determined by the auxiliary adjusting means used before, can be moved along until being entered between the clamping jaws whereupon the clamping jaws are moved towards each other for clampingly holding the instrument between them. Advantageously, the clamping jaws have their mutually facing side faces provided with profiled rubber covers for increasing their "gripping capacity".

Advantageously, the two holding arms between which the auxiliary adjusting means is inserted have a bar rotatably supported therebetween for longitudinal guidance and clamping fixation of the clamping means on said bar. By rotation of the bar about the two rotational points on the holding arms, the clampinmg means can be rotated about a horizontal axis. Since the clamping means can be longitudinally displaced relatoiv to the bar, the clamping means can be moved still further. The clamping means itself advantageously consists of a plate supported on the bar through rollers and having the clamping jaw arrangement rotatably supported thereon. Since it is possible to pivot the bar, to displace the clamping means along the bar and to rotate the clamping jaw arrangement, the clamping means and the clamping jaw arrangement can be brought into the respective required position for clamping the instrument preset by the auxiliary adjusting means.

Advantageously, the above bar is a linear profiled rod of rectangular section, with the clamping means being guided for displacement along said rod. The profiled rod has its ends connected to the holding arms by two radially projecting arm members.

Preferably, the bar between the rotating points on the two holding arms has semicircular shap; due to this shape of the bar, the clamping point where the clamping means engages the instrument at the working handle always keeps the same distance to the instrument end to be treated, irrespective of the position of the clamping means relative to the bar. In addition, this semicircular shape of the bar has the advantage that, by displacing the clamping means along the bar, the instrument is rotated about the "grinding center"; this is because the clamping means is rotated by moving the bar about that point to which the instrument end to be treated has been adjusted by the auxiliary adjusting means, since the also latter is inserted between the rotational points of the bar at the two holding arms and carries its clamping unit and its optical marking, respectively, in the center. According to a further embodiment of the invention, the bar between the rotating points on the two holding arms is provided to have U-shape; by displacing the clamping means along the bar, the distance between the "grinding center" and the clamping point is changed.

An embodiment of the invention will be explained in greater detail hereunder with reference to the drawings.

DESCRIPTION OF THE PREFERRED EMBODIMENTS

Figure 1:
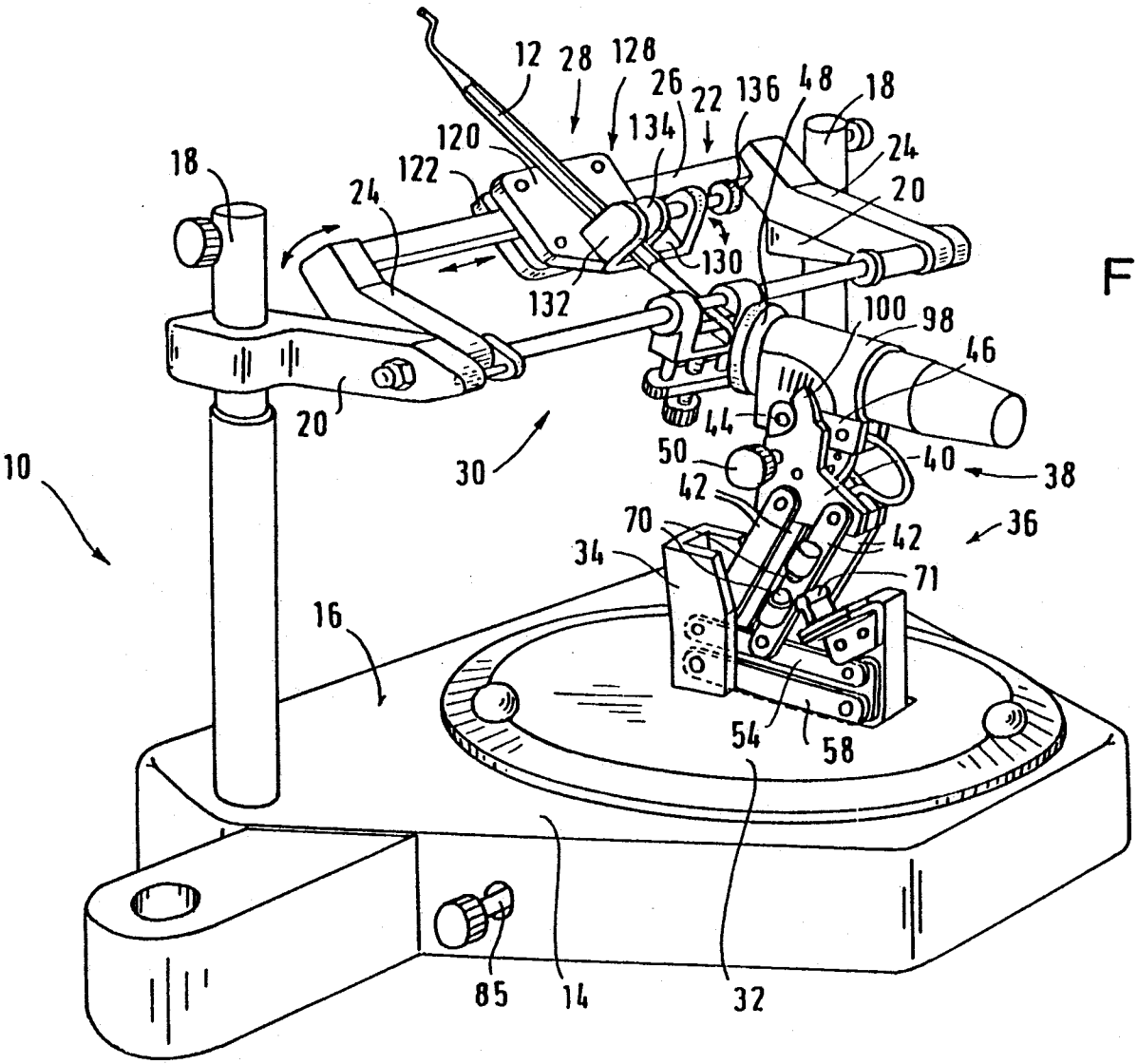
FIG. 1 is a perspective view of the grinding machine having a grinding body abutting against an instrument to be ground.

FIG. 1 is a perspective view of a grinding machine 10 for the sharpening, grinding and polishing of a dental, parodental and/or surgical instrument 12. The grinding machine 10 has a base housing 14 with two upright arms 18 projecting from the upper side 16 thereof. Arms 18 carry transverse arms 20 extending in horizontal direction and parallel to the upper side 16 of base housing 14. Between the ends of said parallel transverse arms 20, a holding bar 22, being substantially U-shaped in plan view, is supported for rotation about a horizontal axis. Holding bar 22 is provided with two parallel transverse arms 24 having their ends rotatably attached to transverse arms 20 of arms 18. Holding bar 22, between the two transverse arms 24 thereof, is provided with a linear guide bar 26. On this guide bar 26, there is guided for longitudinal displacement a still to be described clamping means 28 for clamping the instrument 12 to be treated for longitudinal displacement. Between transverse arms 24 of holding bar 22, a substantially rod-like auxiliary adjusting means 30 is detachably inserted. This auxiliary adjusting means 30, which will still be explained in greater detail, extends coaxially to the horizontal pivoting axis of holding bar 22 and is secured against rotation to one of transverse arms 20 of arms 18, i.e. does not rotate along with holding bar 22 when the latter is pivoted.

The upper side 16 of base housing 14 has rotatably arranged thereon a rotary disk 32 carrying an upright holding member 34. On this holding member 34, a support structure 36, consisting of several arms, is supported to be pivoted about an horizontal axis. Support structure 36 supports a two-part bearing block 38. Bearing block 38 comprises a first element 40 articulated to four substantially vertical support arms 42. The second element 46 of bearing block 38 is connected to first element 40 of bearing block 38 while being capable of being pivoted about an axis 44. The second element 46 comprises an electric motor whose drive shaft is uited for having a grinding body 48 coupled thereto. A fixing screw 50 serves for fixing the two elements 44,46 of bearing block 38 relative to each other.

Next, a more detailed description of support structure 36 will be given with reference to FIG. 2. The four support arms 42 are articulated to the second element 46 of bearing block 38, i.e. supported for rotation about axes 52 on bearing block 38. The lower ends of the four support arms 42, facing away from bearing block 38, are connected in pairs through a connecting member comprising two horizontal arms 54, the connecting points being provided as rotatinal axes 56. The four axes 52,56 form the corner points of a vertical parallelogram consisting of the second element 46 of bearing block 38, the horizontal arms 54 and the support arms 42.

The connecting point of the horizontal arms 54 to two of the support arms 42 is also the rotating point of support structure 38 about holding member 34. The horizontal arms 54 form part of the a horizontal second parallelogram consisting of further horizontal arms 58 articulated to holding member 34 for pivoting about an axis 60. The ends of horizontal arms 54,58 facing away from holding member 34 are connected through a vertical arm 62 and can be pivoted about rotational axes 64 relative to arm 62. The rotational axis 56 connected to holding member 34 and the rotational axes 60,64 also define the corners of a parallelogram consisting of horizontal arms 54,58, holding member 34 and vertical arm 62.

Between one pair of support arms 42 and holding member 34, there is arranged a spiral tension spring 66 for biasing the support structure 38 into the vertical position or into a position in which the grinding surface 68 of grinding body 48 abuts the end of instrument 12 to be ground. The support structure 38 can be manually moved backwards against the force of spring 66 until two snap-in elements 70 are caught on a holding portion 71 (see especially FIGS. 2 and 4).

Figure 2:
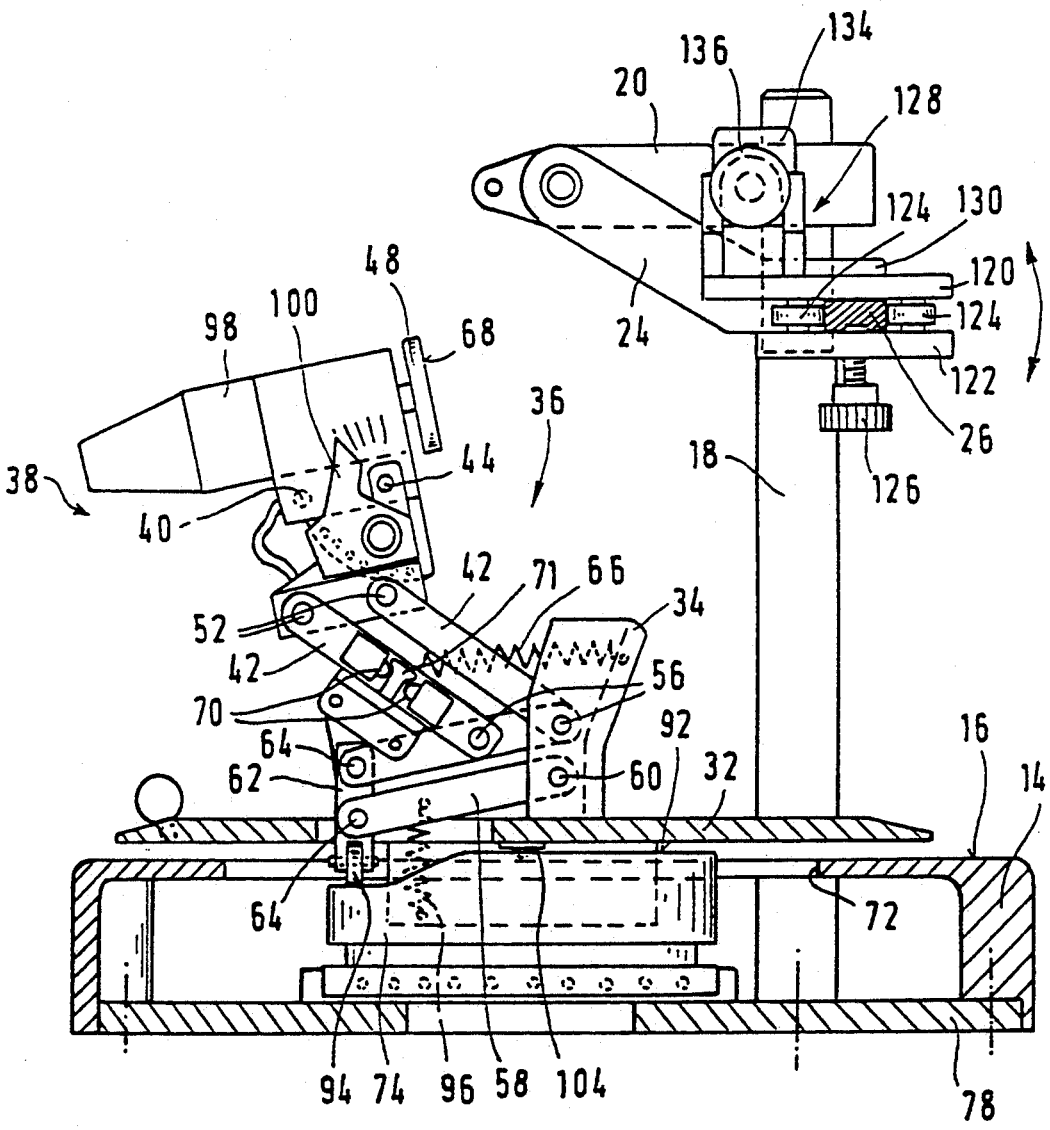
FIG. 2 is a side view of the grinding machine according to FIG. 1, with the grinding body being in its rest position.
Figure 4:
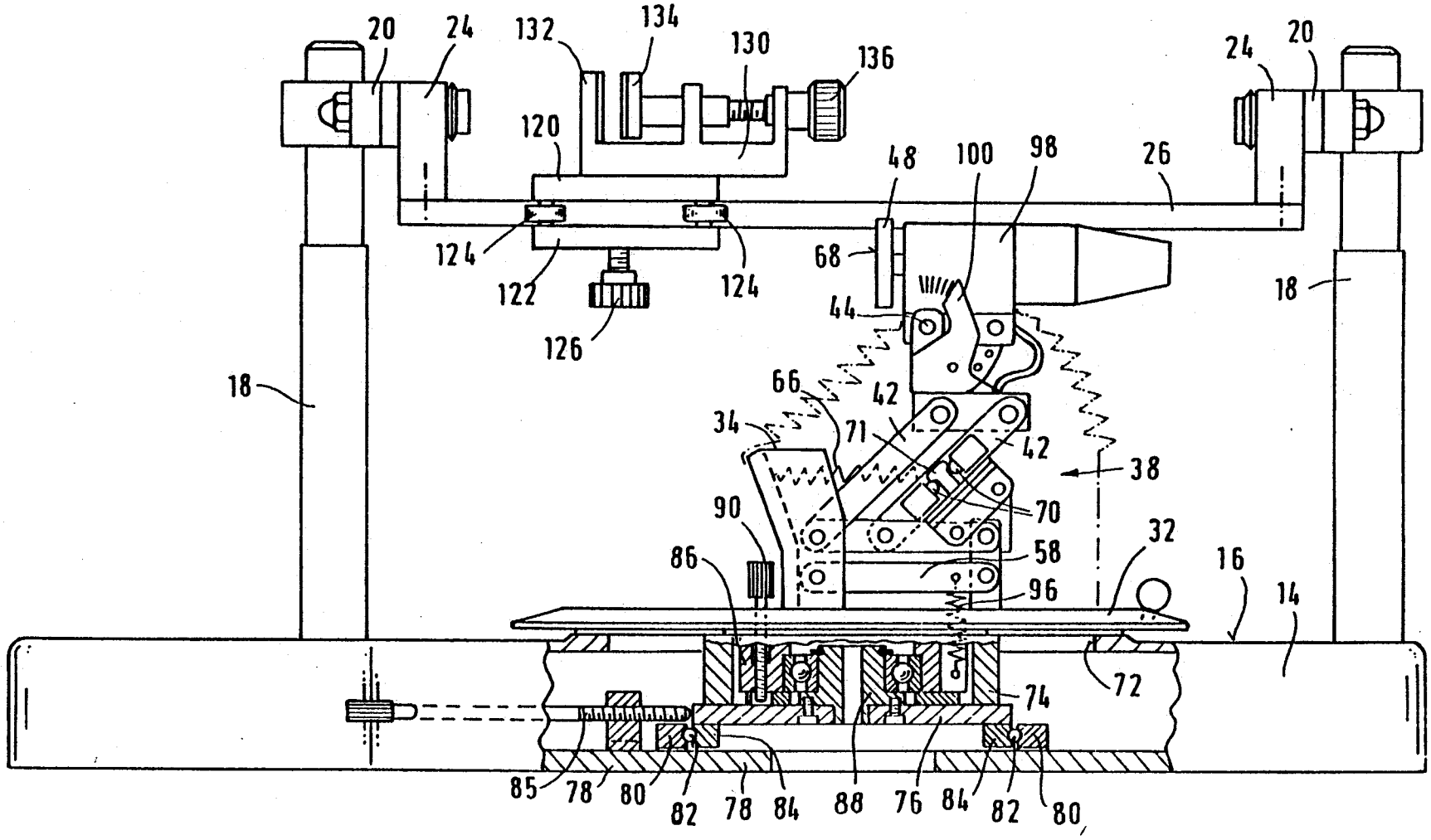
FIG. 4 is a front view of the grinding machine according to FIG. 3.
Figure 6:
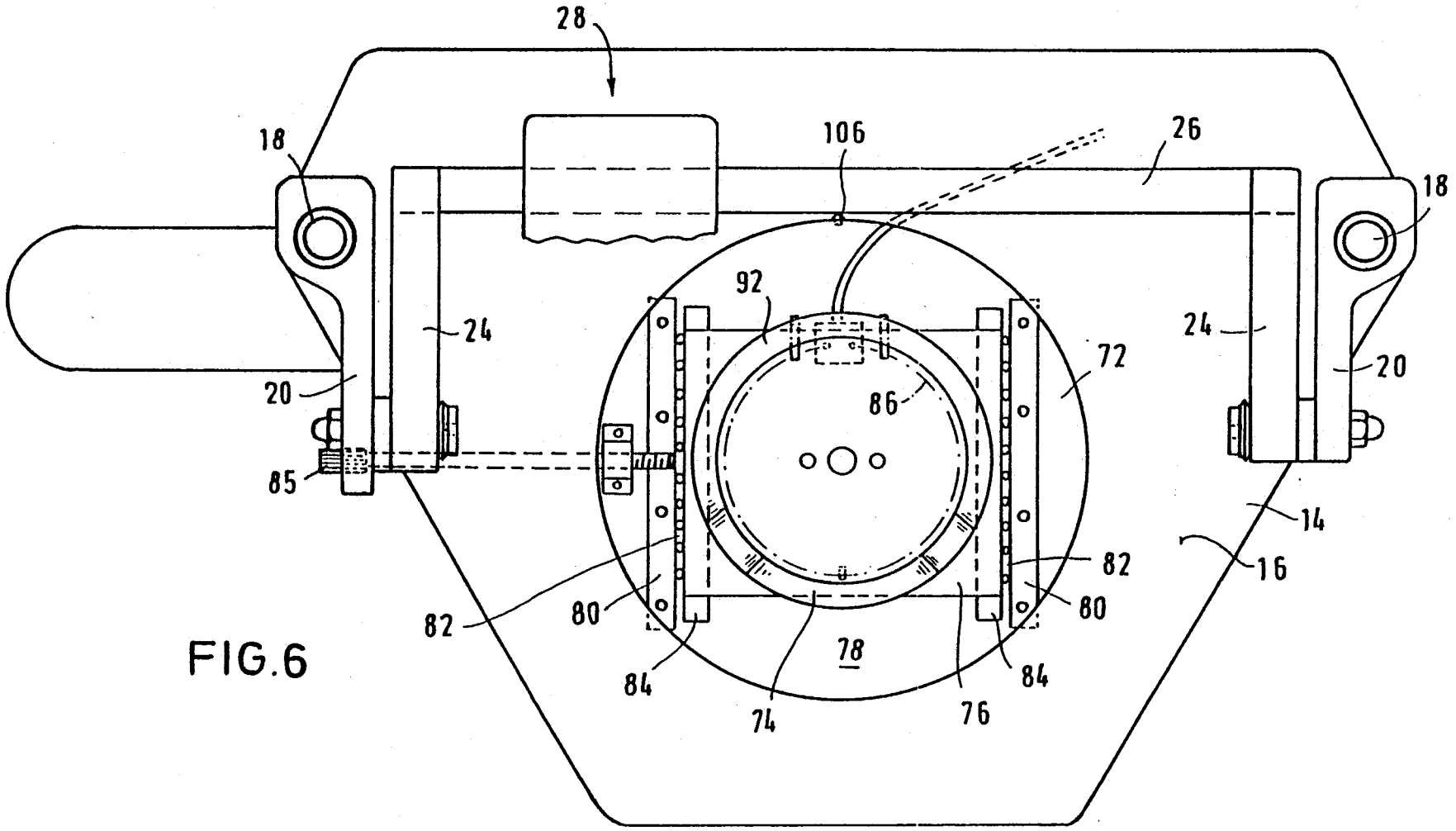
FIG. 6 is a plan view of the grinding machine, with the support structure and the rotary disk being removed.

As is evident from FIGS. 2 and 4, the upper side 16 of base housing 14 has an opening 72 formed therein, accommodating a control member provided as an annular body 74. Annular body 74 is fastened on a holding plate 76 guided for longitudinal displacement on the bottom 78 of base housing 14. To this purpose, two parallel bars 80 are mounted on the bottom, being connected through roller bearings 82 to holding plate 76 or to bars 84 attached to the underside thereof. As evident from FIG. 4 and especially also from the plane view of FIG. 6, the mutually parallel bars 80,84 extend in a direction rectangular to the linear guide bar 26 of holding bar 22. Thus, holding plate 76 can be nmoved towards and away from the clamping means which in FIG. 6 is only schematically shown at 28. Through a fixing crew 86 projecting laterally from base housing 14 and acting on holding plate 76 according to FIG. 4, holding plate 76 can be fixed in its respective position of longitudinal displacement or the friction force can be increased when moving the holding plate 76.

As shown or schematically indicated in FIGS. 2, 4 and 6, annular body 74 extends coaxially about a cylindrical body 86 being fixedly connected to rotary disk 32 from below. The underside of cylindrical body 86 carries a rotatable coaxial shaft running in ball bearings and being screwed to holding plate 76 (see FIG. 4). In this manner, rotary disk 32 and thus holding member 34 and support structure 38 are rotatably supported on holding plate 76. A fixing screw 90 upwardly projecting out of rotary disk 32 serves for fixing the cylindrical body 86 relative to holding plate 76.

Figure 3:
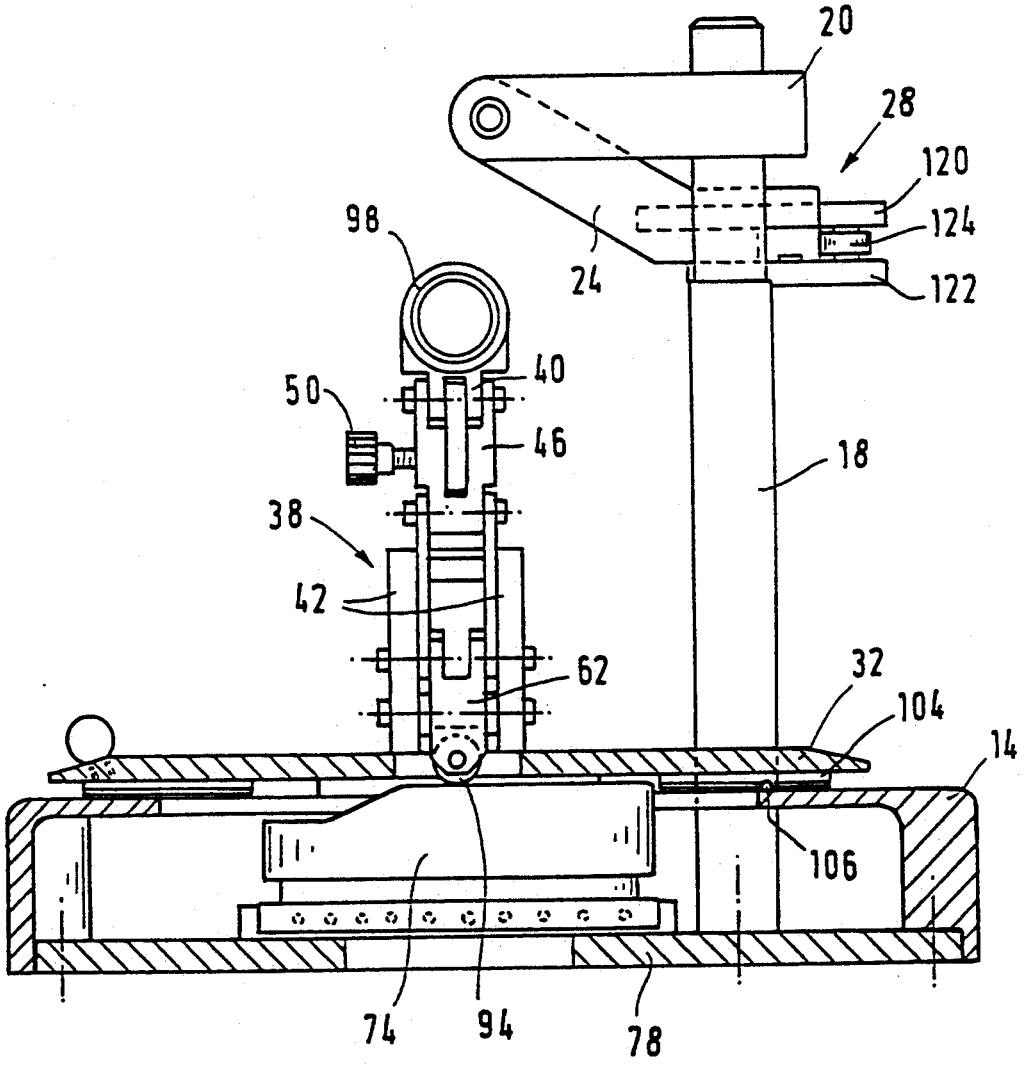
FIG. 3 is a further side view of the grinding device, the support structure along with the grinding body being rotated by 90° as compared to the arrangement shown in FIG. 2.

As can be seen especially from FIGS. 2 and 3, the vertical arm 62 of the horizontal parallelogram one of whose horizontal arms 54 forms part of support structure 38, is supported on the annular facial surface 92. To this purpose, vertical arm 62 has its lower end provided with a roller 95 rolling on said annular facial surface 92 upon rotation of rotary disk 32. (In such a rotation of rotary disk 32 together with the protruding holding member 34 and the support structure 38, the annular body 74 cannot follow the rotation because it is rigidly fixed to holding plate 76.) Through a stepped portion of the upper end of annular body 74 facing rotary disk 32, the vertical arm 62*b* upon rotation of rotary disk 32 performs an upward and downward movement while maintaining its vertical orientation because of the parallelogram guidance through the horizontal parallelogram. By this movement of vertical arm 62, support structure 38 is tilted, resulting in a change of the inclination of grinding surface 68. The stepped portion of annular body 74 is located in that angular region in which grinding surface 68 is moved about the tip of the end of instrument 12 to be ground. By the lowering of vertical arm 62 because of the stepped portion of annular body 74 in this angular region, the angle of grinding surface 68 to the vertical line is enlarged.

As described above, vertical arm 62 during rotation of support structure 38 or rotary disk 32 scans the annular facial surface 92 of annular body 74, with the movement of vertical arm 62 being controlled by annular facial surface 92, the latter thus being the control face of annular body 74. For providing that roller 94 is in continuously abutment on annular facial surface 92, one of the further lower horizontal arms 58 of the horizontal parallelogram is biased in downward direction by a torsional spring 96 engaging on cylinder body 86 so that roller 94 is pressed into abutment on annular facial surface 92.

As already mentioned above, bearing block 38 is adapted to be pivoted. In doing so, the first element 40 of bearing block 38 is pivoted against the second element 46 of bearing block 38 connected to support arms 42. To thus purpose, there is provided an arresting connection between these two elements, one of these elements being a spring-loaded arresting element and the other bearing block element comprising a plurality of arresting recesses. The first bearing block element 40, at the same time carrying the housing 98 of a drive motor for grinding body 48, is provided with a scaling which upon pivoting of the two bearing block elements against each other is pivoted relative to a pointer element 100 rigidly connected to the second bearing block element. By this pivoting of the first element 40 relative to the second element 46 of bearing block 38 about pivoting axis 44, the inclination of grinding surface 68 can be preset and adjusted to the instrument to be treated. The additional change of the inclination of grinding surface 68 upon rotation of rotary disk 32 is determined by the shape and contour of the annular facial surface 92 of annular body 74.

Figure 5:
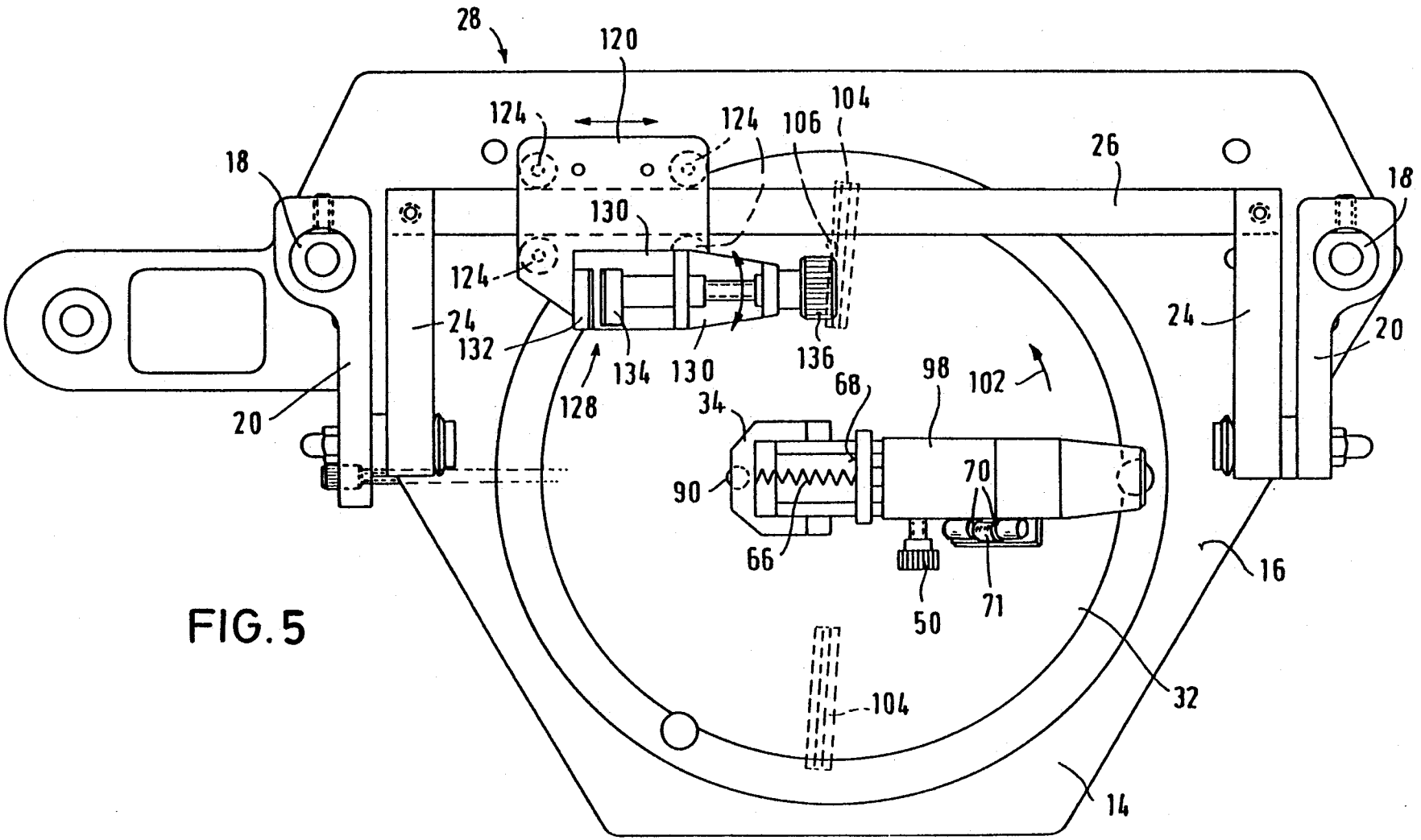
FIG. 5 is a plan view of the grinding machine.

For preventing further rotation of rotary disk 32 in the rotational direction marked by 102 in FIG. 5, the lower side of rotary disk 32 has arranged thereon two stopper ribs 104 arranged opposite each other at a displacment angle of 180° and extending in radial direction. Said stopper ribs 104 cooperate with an snap-in ball 106 arranged at the upper side 16 of base housing 14 in the peripheral area of opening 72, with the stopper ribs 104 abutting against said snap in ball 106 upon rotation of rotary disk 32. Thereby, the rotating movement of support structure 38 or grinding body 48 is limited to 180°, the grinding surface in both of the rotational end positions being arranged at a right angle to the linear guide bar 26 of the holding bar 22 for clamping means 28 (such a limit position can be seen in plan view in FIG. 5). Irrespective of the current longitudinal displacement position of holding plate 76, the snap-in ball 106 will always be in the rotating region of stopper ribs 104 so that the stopping function is safeguarded at all times. Only on manual application of a stronger rotational force on the rotary disk 32, the stoppers limiting the rotational movement can be overcome in that the snap-in ball 106 evades against the force of the spring of the respective stopper rib 104.

The clamping means 28 will be shortly described hereunder with particular reference to FIGS. 1 and 5. On both sides of guide bar 26, clamping means 28 is provided with plates 120,122 having cylindrical rollers 124 rotatably supported therebetween, the peripheral faces of said rollers 124 abutting the guide bar 26 on both sides of bar 26. The lower plate 122 is provided with a fixing screw 126 for fixing the two plates 120,122 in a specific position on guide bar 26 relative thereto. The upper plate 120 carries a clamping jaw arrangement 128. The clamping jaw arrangement 128 comprises a base plate 130 rotatable connected to plate 120 and carrying a fixed clamping jaw 132. Further, there is provided a movable clamping jaw 134 which can be moved towards and away from the fixed clamping jaw 132 when turning a screw 136. The mutually facing inner faces of clamping jaws 132,134 are provided with profiled rubber portions. The movements which can be performed by guide bar 26 between holding arms 18, by clamping means 28 along guide bar 26 and by the clamping jaw arrangement 128 relative to plate 120 of clamping means 28, are indicated by double arrows in FIG. 5.

Figure 7:
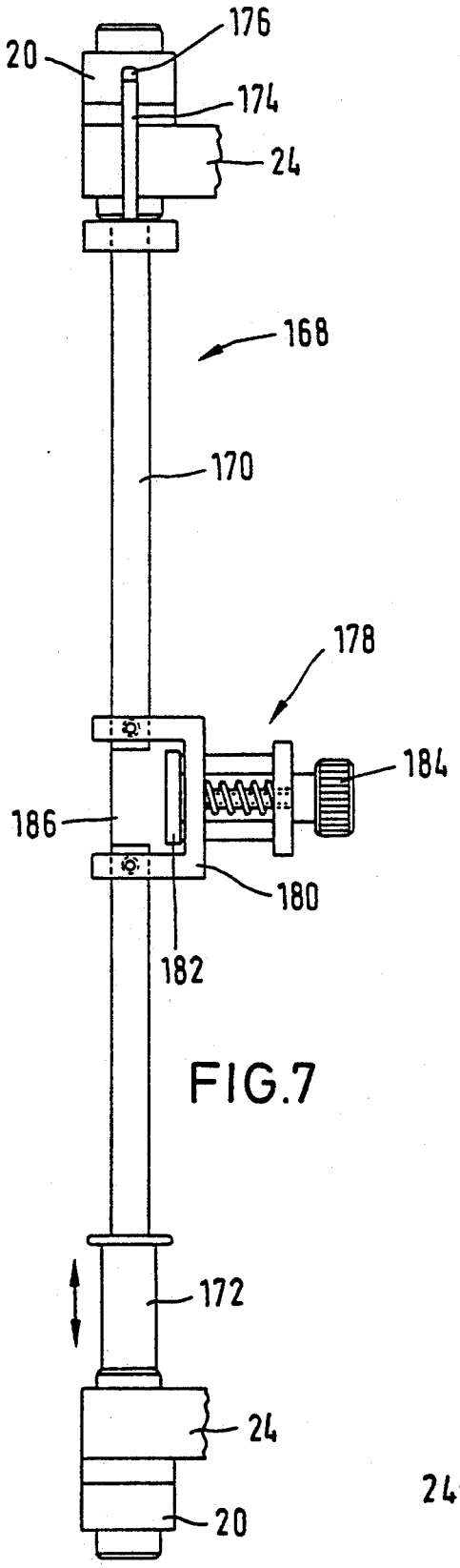
FIG. 7 is a plan view of a first embodiment of an auxiliary adjusting means for adjusting the instrument end to be ground.
Figure 8:
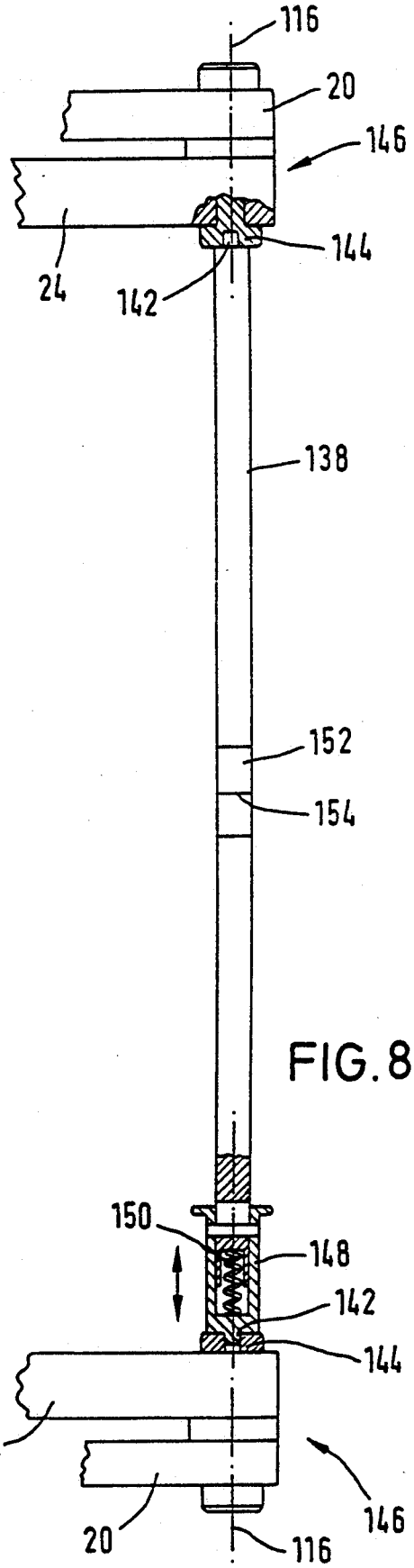
FIG. 8 shows a second embodiment of an auxiliary adjusting means.
Figure 9:
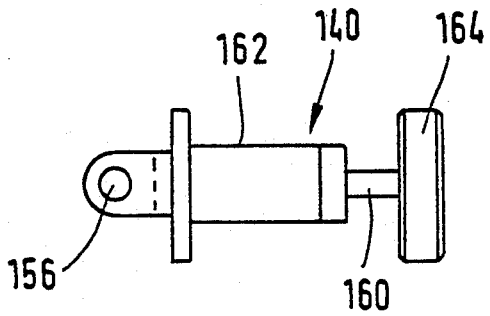
FIGS. 9 and 10 are a side view and a plan view, partially in section, of a further auxiliary adjusting means.
Figure 10:
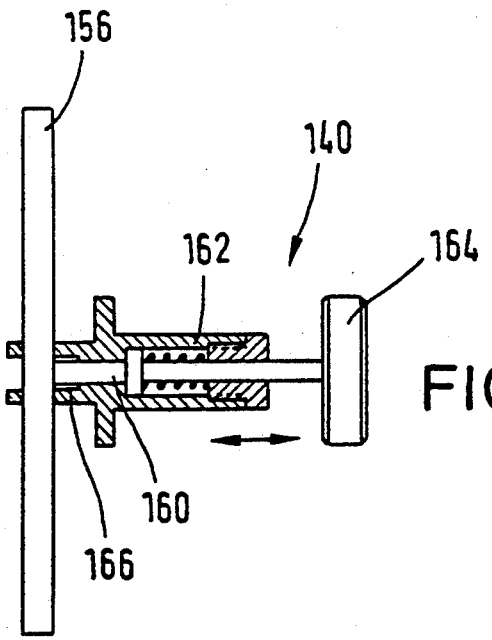

In FIGS. 7 through 10, there are shown several embodiments of auxiliary adjusting means by which the instrument 12 to be treated, prior to being clamped by clamping means 28, can be positioned or adjusted in such a manner that the facial surface of instrument 12 extends in plane parallel orientation, i.e. at a right angle to the rotational axis of the support structure. In the first embodiment, the auxiliary adjusting means 138,140 of FIGS. 8 through 10 are used to this purpose. The auxiliary adjusting means 138 is a rod having its end side provided with pins 142. These pins 142 engage into receiving holes 144 located on the joints 146 between the transverse arms 20 of arms 18 and the transverse arms 24 of holding bar 22 and extending coaxially to rotational axis 116. On one of the two ends of rod 138, there is arranged a spring-loaded bushing 148 to be displaced in axial direction of rod 138 and having said pin 142 arranged thereon. The movement of bushing 148 is indicated by a double arrow in FIG. 8. Spring 150 pushes bushing 148 away from the rod so that rod 138 is held clamped by spring 150 between the joints 146 or, respectively, the transverse arms 24 of holding bar 22. By movement of bushing 148 against the spring force 150, pin 142 is brought out of engagement with receiving hole 144 so that the auxiliary adjusting means can be taken out of the device. In a like manner, the auxiliary adjusting means can be inserted into the device while bushing 148 is in the retracted position.

In the center of rod 138, there is formed a flattened portion 152 provided with an optical marking formed as a groove 154 extending laterally to rod 138. By orientation of the end of the instrument to be treated parallel to groove 154, the height and center positioning of the instrument can be carried out with the instrument end resting on said flattened portion 152. The instrument, manually held in the respective position, is then clamped on the working handle by clamping means 28. Subsequently, the auxiliary adjusting means 138 can be removed.

For adjusting the thus clamped instrument in such a manner that its facial surface extends in horizontal direction, the auxiliary adjusting means 140 of FIGS. 9 and 10 is now mounted onto the instrument end to be treated. The auxiliary adjusting means 140 comprises an adjusting pin 156 having connected thereto a substantially cylindrical housing 158 extending radially to the centering pin 156. In housing 158, a pin 160 is guided for longitudinal displacement, said pin 160 being biased by a spring 162 in the direction of centering pin 156. Pin 160 projects out of housing 158 at the end thereof averted from centering pin 156. At this end of pin 160, there is arranged a knob 164 or the like for manual withdrawal of pin 160 against the force of spring 162. On its end adjacent centering pin 156, housing 158 is provided with a passage 166 extending transversely to centering pin 156 and housing 158 and being formed as a continuous recess. By retracting knob 164 against the force of spring 162, pin 160 unblocks the passage 166 so that the auxiliary adjusting means 140 can now be mounted on the instrument end to be sharpened in that the instrument end enters into passage 166. Now, knob 164 is released so that centering pin 156 presses with the force of spring 162 against the facial surface of the instrument to be treated. In doing so, centering pin 156 is in a position corresponding to the orientation of the facial surface. By pivoting of the guide bar 26, longitudinal displacement of the clamping means 28 along guide bar 26 and rotation of the clamping jaw arrangement 128 relative to plate 120 of clamping means 28, the instrument can be brought into a position wherein the adjusting pin 156 extends horizontally. Thus, also the facial surface is oriented in horizontal direction; after removal of the auxiliary adjusting means 140, the actual grinding process can be started.

A slightly different approach with respect to the orientation of the facial surface in parallel to the horizontal line is followed by the auxiliary adjusting means 168 shown in FIG. 7. As in the auxiliary adjusting means shown in FIG. 8, also the auxiliary adjusting means 168 comprises a rod 170, with one end thereof having a spring-loaded bushing 172 having a locking pin arranged thereon. Also the other end of rod 170 is provided with a locking pin. Also the auxiliary adjusting means 168 is inserted between the joints 146 connecting guide bar 26 to transverse arms 20, as described in connection with auxiliary adjusting means 138. In order to prevent rotation of the inserted auxiliary adjusting means 168 about rod 170, the end of rod 170 opposite bushing 172 has provided thereon a further locking pin formed as a locking pin member 174 extending parallel to rod 170 and engaging into a receiving hole 176 at joint 146. By double locking of rod 170 on one of both ends thereof, rotation of auxiliary adjusting means 168 is prevented.

In the intermediate portion of rod 170, there is arranged a clamping unit 178 comprising a U-shaped holding body 180 having both of its legs connected to rod 170. On the U-shaped holding body 180, a pressing plate 182 is displaceably guided which by turning an adjusting screw 184 can be moved towards rod 170 or away from it in radial direction. In the region 186 opposite the pressing plate 182, rod 170 has a reduced section, with the face of rod 170 directed towards pressing plate 182 extending at the height of the center line of rod 170. This surface area of rod 170 extending at the height of the center line is domed or forms a rounded surface which upon clamping the instrument end between rod 170 and pressure plate 182 abuts on the facial surface of the instrument. This rounded face prevents tilting of the instrument when the latter is clamped in the clamping unit 178 in the region of the facial surface. For adjusting the instrument, the end thereof to be treated is first clamped, through clamping unit 178, between pressure plate 182 and rod 170 in the region of portion 186 of rod 170, as explained above.

At this time, the auxiliary adjusting means 168 is in its inserted position between the holding arms. The instrument held clamped by clamping unit 178 has a specific position which is determined by the type of the instriument, its facial surface and the clamping point. The thus held instrument can now be "approached" by pivoting the guide bar 26, displacing the clamping means 28 and rotating the clamping jaw arrangement 128, in order to be clamped between the clamping jwas 132 and 134. Thus, the instrument, while being held by clamping jaw arrangement 128 of clamping means 28, is in the position previously assumed by means of auxiliary adjusting means 168. After release of the adjusting screw 184 and removal of auxiliary adjusting means 168, the actual grinding process can be started.

By the above described auxiliary adjusting means, it is possible to adjust the instruments in such manner that exact grinding can be performed with the grinding body. Exact grinding of the instrument is an essential condition for avoiding that subsequent use of the instrument causes injuries to the patient due to incorrect grinding of the instrument. The auxiliary adjusting means allow adjustment or presetting of a plurality of dental, parodental and/or surgical instruments. All of these instruments can be clamped with the described clamping means because its clamping jaw arrangement is provided in such a manner that the instrument can be inserted from the side.

What is claimed is:

1. A device for the sharpening, grinding and polishing of dental, parodental or surgical instruments, comprising clamping means (28) for clamping the instrument (12) to be ground, grinding body (48) provided with a grinding surface (68) and being rotatably supported on a bearing block (38), a base housing (14) having a rotatably supported support structure (36) projecting therefrom for holding said bearing block (38), said support structure (36) comprising at least two support arms (42) respectively articulated to the bearing clock (38), and at least one connecting member (54) additionally connecting said support arms (42), control member (74) having the support structure (36) abutting thereon and by which the support structure (36) and, through the support structure (36), the bearing block (38) holding the grinding body (48) is pivoted by pivot means (44, 52, 56) for changing the inclination of the grinding surface (68), said support structure (36) is rotatably arranged and the control member (74) is rigidly arranged on a common holding element (76) supported by the base housing (14) for longitudinal displacement along at least one axis extending perpendicularly to a rotational axis of the support structure (26), and fixing means (85) for fixing the holding element (76) and for releasing the fixed holding element (76).

2. A device for sharpening grinding and polishing of dental, parodental or surgical instruments according to claim 1 including said connecting member (54) rests on the control member (74) and upon rotation of the support structure (36) can be pivoted up and down by the control member (74).

3. The device according to claim 1 characterized in that the connecting member (58) is provided with a scanning element (62,94) which upon rotation of the support structure (34) is moved along a control face (92) provided on the control member (74), the contour of said control face (92) being formed in such a manner that the connecting member (58) assumes different pivoting positions upon rotation of the support structure (74).

4. The device according to claim 3, characterized in that the scanning element (62) comprises a movable body (94) abutting the control face (92).

5. The device according to claim 3, characterized in that the connecting member (54) is articulated to an arm (62) being in turn articulated to a further connecting member (58) pivoted in the same manner as the other connecting member (54) to a rotatable holding member (34), the four connecting points (56,60,64) of the two connecting members (54,58) to the holding member (34) and said arm (62) forming the corner points of a parallelogram, and that said arm (62) comprises the scanning element (94) abutting the control face (92) of the control member (74).

6. The device according to claim 1, characterized in that the control member (74) is a cylindrical annular body arranged coaxially to the rotational axis of the support structure (36) and having one of its annular end faces provided as a control face (92) for controlling the movement of the connecting member (54) upon rotation of the support structure (36), the annular body (74) having portions of different axial lengths when seen circumferential direction.

7. The device according to any one of claim 1, characterized in that two stoppers (104,106) are provided for limiting, in both directions, the rotational angle by which the support structure (36) can be rotated, in such a manner that the grinding surface (68) comes into contact only with the lateral faces and the tip of the instrument (12) to be sharpened.

8. The device according to claim 7, characterized in that the two stoppers (104,106) are arranged to be resilient and allow further rotation of the support structure (36) when exceeding a specific rotational force.

9. The device according to claim 1, characterized in that the bearing block (38) comprises a first element (40) rotatably holding the grinding body (48), and a second element (46) connected to the at least two support arms (42), and that the first element (40), for presetting the inclination of the grinding surface (68) of the grinding body (48), is pivotably supported on the second element (46) and can be fixed in the respective pivoting positions.

10. A device for the sharpening, grinding and polishing of dental, parodental or surgical instruments to claim 1 including an auxiliary adjusting means (138, 140; 160) for adjusting the instrument (12) prior to clamping by the clamping means (28) by clamping an end of the instrument (12) such that a facial surface of the instrument (12) extends perpendicularly to a rotational axis of the support structure (36), and the clamping means (28) is movable along a plurality of axes so that the clamping means (28), while the instrument is held by the auxiliary adjusting means (138, 140; 146), can be moved to the instrument in such a manner that the instrument (12), while maintaining its orientation determined by the fixing of the end to be treated, can be clamped on its handle portions.

11. The device according to claim 10, characterized in that the auxiliary adjusting means (138,140;168) is arranged between two holding arms (18) respectively projecting from the base housing (14).

12. The device according to claim 11, characterized in that the two holding arms (18) have rotatably arranged thereon the two ends of a holding bar (26) on which the clamping means (28) can be guided in longitudinal direction and be clampingly fixed.

13. The device according to claim 12, characterized in that the clamping means (28) comprises a plate (120) supported on the holding bar (26) through rollers (124), on which plate (120) a clamping jaw arrangement (128) is rotatably supported and can be clampingly fixed in the rotational position, said clamping jaw arrangement (128) comprisng a stationary first clamping jaw (132) and a displaceable second clamping jaw (134).

14. The device according to claim 13, characterized in that the space between the clamping jaws (132,134) is open on all sides except for the side facing the plate (120).

15. The device according to claim 12, characterized in that the holding bar (26) between the two points of rotation between the two holding arms (42) is of substantially U-shaped configuration with a linear central portion and two portions connecting said central portion to the holding arms and the clamping means (28) is rotatable relative to the holding bar (26) and can be clampingly fixed in its rotational position thereon.

16. The device according to claim 12, characterized in that the auxiliary adjusting means (168) comprises a rod (170) to be inserted between the two points of rotation of the holding bar (26), the central portion of said rod (170) comprising a clamping unit (178) for holding the instrument at the end to be treated.

17. The device according to claim 16, characterized in that the clamping unit (178) comprises a stationary first clamping jaw (186) extending in the longitudinal direction of the rod (170), and a second clamping jaw (182) to be moved radially to the rod (170) and being displaceably supported on a holding element (180) connected to the rod (170), and that the first clamping jaw (186) has a rounded surface opposite the second clamping jaw (182).

18. The device according to any one of claim 10, characterized in that the auxiliary adjusting means (138,140;168) can be inserted between the two holding arms (42) while being secured against rotation.

19. The device according to claim 18, characterized in that the auxiliary adjusting means (168) at its ends facing the holding arms (18) is provided with pins (142) for engaging associated receiving holes (144) on the holding arms (18), two of such pins (142,174) being arranged on one end and a spring-biased pin (142) being arranged on the other end.

20. The device according to claim 10, characterized in that the auxiliary adjusting means comprises a rod (138) to be inserted between the two holding arms (18) and having a marking (154) for optical adjustment of the instrument end to be treated prior to clamping the instrument in the clamping means (28).

21. The device according to claim 10, characterized in that, for plane parallel adjustment of the facial surface of the instrument to be treated and clamped in the clamping means (28), there is provided a further auxiliary adjusting means (140) which is adapted to be mounted on the instrument and, for clamping fixation on the facial surface, comprises a pin (156) resiliently pressing thereon, the clamping means (128) being displaced until said pin (156) is oriented horizontally.

22. A device for the sharpening, grinding and polishing of dental, parodental or surgical instruments, comprising a grinding body (48) provided with a grinding surface (68) and being rotatably supported on a bearing block (38), a base housing (14) having a rotatably supported support structure (36) projecting therefrom for holding said bearing block (38), said support structure (36) comprising at least two support arms (42) respectively articulated to the bearing block (38), at least one connecting member (54) additionally connecting said support arms (42), and a control member (74) having the support structure (36) abutting thereon and by which the support structure (36) and, through the support structure (36), the bearing block (38) holding the grinding body (48) is pivoted by pivot means (44, 52, 56) for changing the including of the grinding surface (68), said support structure (36) is rotatably arranged and the control member (74) is rigidly arranged on a common holding element (76) supported by the base housing (14) for longitudinal displacement along at least one axis extending perpendicularly to a rotational axis of the support structure (26), and fixing means (85) for fixing the holding element (76) and for releasing the fixed holding element (76), and a connecting member (54) resting on the control member (74) and upon rotation of the support structure (36) is pivoted up and down by said control member (74).

23. A device for the sharpening, grinding and polishing of dental, parodental or surgical instruments, comprising a clamping means (28) for clamping the instrument to be ground, a grinding body (48) provided with a grinding surface (68) and being rotatably supported on a bearing block (38), a base housing (14) having a rotatably supported support structure (36) projecting therefrom for holding said bearing block (38), said support structure (36) comprising at least two support arms (42) respectively articulated to the bearing block (38), at least one connecting member (54) additionally connecting said support arms (42), and a control member (74) having the support structure (36) abutting thereon and by which the support structure (36) and, through the support structure (36), the bearing block (38) holding the grinding body (48) is pivoted by pivot means (44, 52, 56) for changing the including of the grinding surface (68), said support structure (36) is rotatably arranged and the control member (74) is rigidly arranged on a common holding element (76) supported by the base housing (14) for longitudinal displacement along at least one axis extending perpendicularly to a rotational axis of the support structure (26), fixing means (85) for fixing the holding element (76) and for releasing the fixed holding element (76), an auxiliary adjusting means (138, 140; 168) for adjusting the instrument (12) prior to clamping by the clamping means (28) by clamping an end of the instrument (12) such that a facial surface of the instrument (12) extends perpendicular to a rotational axis of the support structure (36), and the clamping means (28) is movable along a plurality of axes so that the clamping means (28), while the instrument is held by the auxiliary adjusting means (138, 140; 146) is moved to the instrument in such a manner that the instrument (12), while maintaining its orientation determined by the fixing of the end to be treated, is clamped on its handle portion.

* * * * *